US006415129B2

(12) United States Patent
Sawayama

(10) Patent No.: US 6,415,129 B2
(45) Date of Patent: Jul. 2, 2002

(54) ELECTROPHOTOGRAPHIC IMAGE FORMING APPARATUS, CLEANING UNIT FOR THE SAME AND BRUSH ROLLER FOR THE SAME

(75) Inventor: Noboru Sawayama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/805,998

(22) Filed: Mar. 15, 2001

(30) Foreign Application Priority Data

Mar. 16, 2000 (JP) ..... 2000-073268
Feb. 9, 2001 (JP) ..... 2001-033803

(51) Int. Cl.[7] ..... G03G 21/00
(52) U.S. Cl. ..... 399/353; 399/346
(58) Field of Search ..... 399/353, 356, 399/343, 346

(56) References Cited

U.S. PATENT DOCUMENTS 5,998,008 A * 12/1999 Shimamura et al. ..... 399/343

FOREIGN PATENT DOCUMENTS

JP 6-337598 12/1994
JP 9-288441 11/1997

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

In an electrophotographic image forming apparatus, a cleaning unit includes a brush roller made up of a paper tube and a cloth rapped around the paper tube. Straight bristles are implanted in the cloth and formed of polyester or polyamide. To form the straight bristles, the tips of loop-like bristles implanted in the cloth are cut off. Assuming that the diameter of the cloth, or brush support, is Ds (mm), then the bristles are implanted in a density ρ of $30/\pi Ds$ or above ($1/mm^2$). The individual bristle has a diameter Df of 0.05 or above (mm) and presses the surface of a photoconductive drum with a mean pressure of $10\times10^{-5}$ (N) or above. The cleaning unit achieves a desirable cleaning ability without reducing the life of the image carrier, while removing contaminants from the surface of the image carrier.

32 Claims, 7 Drawing Sheets

ELECTROPHOTOGRAPHIC IMAGE FORMING APPARATUS, CLEANING UNIT FOR THE SAME AND BRUSH ROLLER FOR THE SAME

BACKGROUND OF THE INVENTION

The present invention relates to a copier, printer, facsimile apparatus, multiplex machine or similar image forming apparatus. More particularly, the present invention relates to an electrophotographic image forming apparatus of the type repeating an image forming process, which includes charging, optical writing, development, image transfer and cleaning, with an image carrier to thereby sequentially form toner images on the image carrier, and sequentially transferring the resulting toner images to recording media, a cleaning unit for cleaning the surface of the image carrier, and a brush roller for the cleaning unit.

It is a common practice with an electrophotographic image forming apparatus to form, in a monochrome mode, a toner image on an image carrier and then transfer the toner image to a paper sheet, OHP (OverHead Projector) sheet or similar recording medium. After the image transfer, a cleaning unit removes toner left on the image carrier to thereby prepare the image carrier for the next image forming cycle.

In a color mode, monocolor images are sequentially formed on the image carrier while being sequentially transferred to an intermediate transfer body or another image carrier one above the other. The resulting color image completed on the intermediate transfer body is collectively transferred to a recording medium. After the image transfer, the surface of the photoconductive element and that of the intermediate image transfer body each are cleaned by a particular cleaning unit.

Each cleaning unit has customarily been implemented with a brush roller, a blade, a magnet brush or a bias roller. The brush roller has loop-like bristles or straight bristles implanted therein. The problem with loop-like bristles is that they press the image carrier, which is formed of OPC (Organic PhotoConductor) or similar resin, with a pressure several ten times to several hundred times higher than the pressure of straight bristles. The loop-like bristles therefore shave off the image carrier and cause a CTL (Carrier Transport Layer) included in the image carrier to wear, thereby reducing the life of the image carrier. Another problem is that such bristles cannot be densely implanted and therefore irregularly scrape off toner, resulting in stripe-like brush marks on the surface of the image carrier. The brush marks lower image density.

Not only toner but also ozone, NOx (nitrogen oxides) and other reactive gases produced by charging and image transfer deposit on the surface of the image carrier. Further, during image transfer, even talc, clay and paper fibers themselves deposit on the image carrier. Talk and clay are used to improve the quality of a paper surface. A cleaning member implemented by the loop brush can remove such deposits (contaminants), but a cleaning member implemented by any one of the straight brush, blade, magnet brush and bias roller cannot easily remove them. This is particularly true with an image carrier having fluorine-contained resin or wax on its surface and having a coefficient of friction of 0.2 or below, as measured by an Euler belt method.

As stated above, a conventional cleaning member with straight bristles cannot fully remove contaminants deposited on the image carrier although it can fully remove toner, as proved by experiments. Also, it was experimentally found that even bristles implanted in a higher density to increase the pressure of the entire brush, as taught in Japanese Patent Laid-Open Publication No. 9-288441 by way of example, failed to solve the above problem. Further, a greater amount of bite of the brush into the image carrier was not a solution to the problem either. The greater amount of bite caused the brush to deform (so-called creep) and thereby caused a torque to vary, resulting in irregular rotation and therefore noise and vibration.

Technologies relating to the present invention are also disclosed in, e.g., Japanese Patent Laid-Open Publication No. 6-337598.

SUMMARY OF THE INVENTION

It is therefore an object of the present invention to improve the cleaning ability of a cleaning unit, which is included in an electrophotographic image forming apparatus, without reducing the life of an image carrier to thereby remove even contaminants, which would lower image quality.

It is another object of the present invention to more surely prevent image quality from being lowered in an electrophotographic image forming apparatus.

It is another object of the present invention to improve the cleaning ability by easily increasing the pressure of a brush.

It is another object of the present invention to allow a brush roller to smoothly rotate without excessively increasing a load to act on an image carrier or causing it to vary.

It is another object of the present invention to further extend the life of an image carrier and promote the easy migration of toner from the image carrier, thereby obviating defective images.

It is still another object of the present invention to provide the surface of an image carrier with a coefficient of friction of 0.3 or below with a simple configuration.

It is yet another object of the present invention to cope with both of a photoconductive element and an intermediate image transfer body, which are specific forms of an image carrier.

It is a further object of the present invention to achieve the above-described objects with a cleaning unit for an electrophotographic image forming apparatus and a brush roller included in the cleaning unit.

In accordance with the present invention, in an electrophotographic image forming apparatus including a brush roller for cleaning the surface of an image carrier, the brush roller has straight bristles implanted in a density $\rho$ ($1/mm^2$) satisfying a relation:

$$\rho \geqq 30/\pi Ds$$

where Ds denotes the diameter (mm) of a brush support included in the brush roller. The bristles each exert a mean pressure of $10\times10^{-5}$ (N) on the surface of the image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
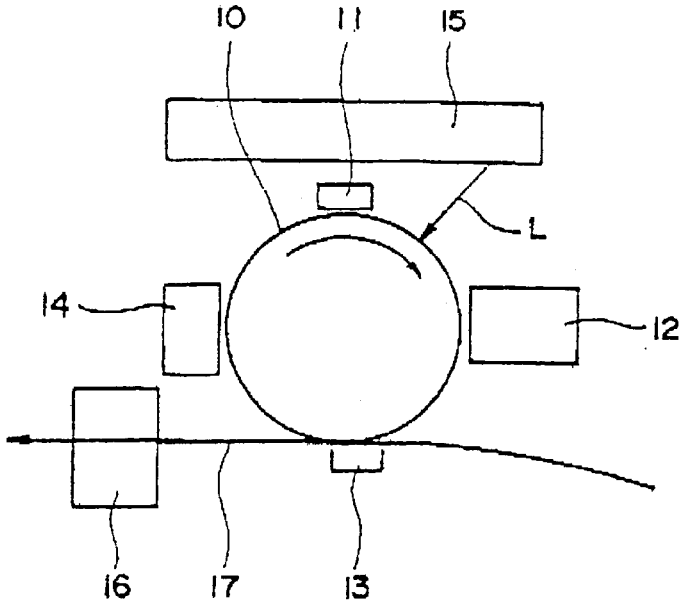
FIG. 1 is a fragmentary view showing an electrophotographic image forming apparatus embodying the present invention.

Referring to FIG. 1 of the drawings, an electrophotographic image forming apparatus embodying the present invention is shown. As shown, the image forming apparatus includes a photoconductive drum 10, which is a specific form of an image carrier. A charger 11 is positioned above and faces the drum 10. The charger 11 extends in parallel to the drum 10. A developing unit 12, an image transfer unit 13 and a cleaning unit 14 are sequentially arranged around the drum 10 in a direction of rotation of the drum 10, which is indicated by an arrow in FIG. 1. An optical writing unit 15 is positioned above the charger 11. A fixing unit 16 is positioned below the cleaning unit 14.

In operation, while the drum 10 is in rotation, the charger 12 uniformly charges the surface of the drum 10. The optical writing unit 15 scans the charged surface of the drum 10 with a light beam L in accordance with image data. As a result, a latent image is electrostatically formed on the drum 10. The developing unit 12 develops the latent image with toner to thereby produce a corresponding toner image. The image transfer unit 13 transfers the toner image from the drum 10 to a paper sheet, OHP sheet or similar recording medium 17 being conveyed below the drum 10.

The cleaning unit 14 removes the toner left on the drum 10 after the image transfer. Subsequently, a discharge lamp, not shown, discharges the surface of the drum 10 to prepare the drum 10 for the next image forming cycle. The paper sheet 17 with the toner image is conveyed to the fixing unit 16. The fixing unit 16 fixes the toner image fixed on the paper sheet 17. The paper sheet 17 is then driven out of the apparatus body to, e.g., a print tray.

Figure 2:
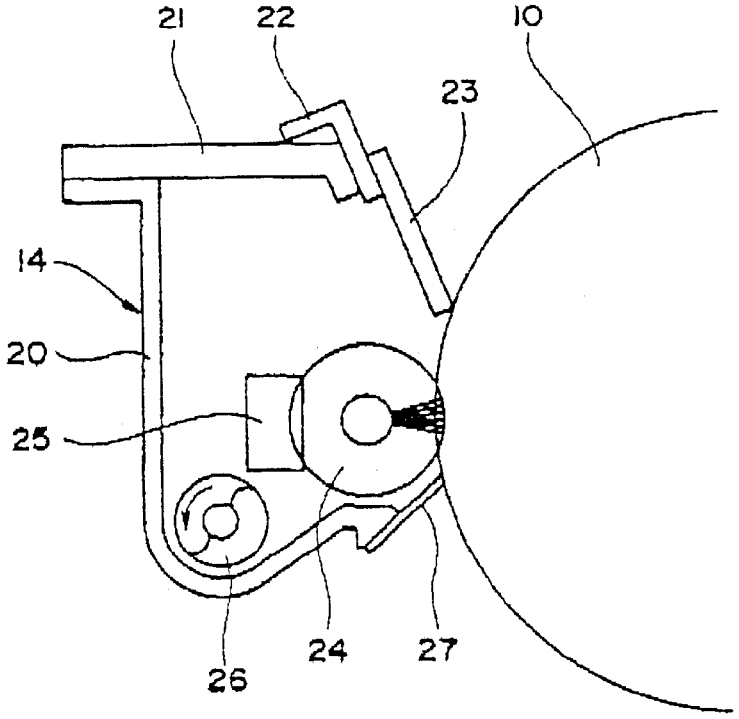
FIG. 2 is an enlarged fragmentary view of a cleaning unit included in the illustrative embodiment.

FIG. 2 shows a specific configuration of the cleaning unit 14. As shown, the cleaning unit 14 includes a casing 20 whose open top is closed by a lid 21. The lid 21 supports a cleaning blade or cleaning member 23 via a blade holder 22. The edge of the cleaning blade 23 is pressed against the surface of the drum 10. The casing 20 rotatably supports a brush roller or another cleaning member 24. The brush roller 24 is pressed against he surface of the drum 10 such that its circumference bites into the drum 10 by a suitable amount. A lubricant 25 is fixedly mounted on the casing 20 and held in contact with the circumference of the brush roller 24.

A screw 26 is disposed in the bottom portion of the casing 20 for conveying toner collected from the drum 10 to one side in the axial direction of the screw 26. A Mylar sheet 27 is fitted on the underside of the bottom open portion of the casing 20 and lightly contacts the drum 10 at its edge. The Mylar sheet 27 prevents toner scraped off by the cleaning blade 23 and brush roller 24 from dropping to the outside of the casing 20.

Figure 3:
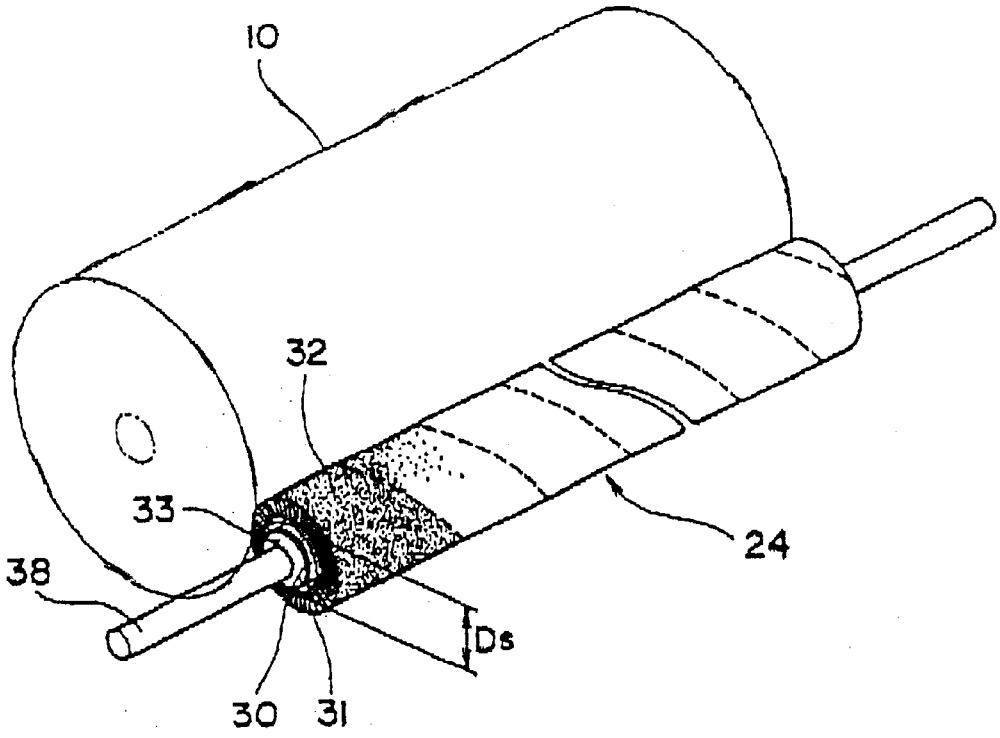
FIG. 3 is an isometric view showing a brush roller included in the cleaning unit in relation to a photoconductive element.
Figure 4:
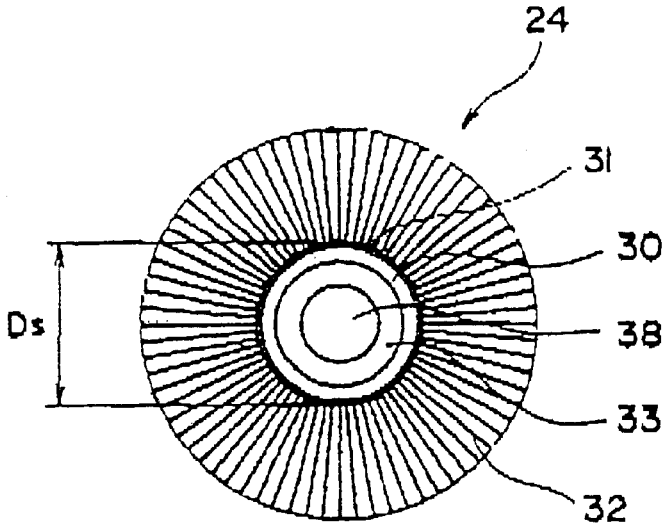
FIG. 4 is an enlarged end view of the brush roller.

As shown in FIGS. 3 and 4, the brush roller 24 includes a shaft 38 provided with a flange portion 33. A paper tube 30 is fitted around the flange portion 33. A cloth 31 with straight bristles 32 implanted therein is wrapped around the paper tube 30. The straight bristles 32 are formed of polyester, polypropylene or polyamide and produced by cutting off the tips of loop-like bristles implanted in the cloth 31.

In the illustrative embodiment, assuming that the cloth or brush support 31 has a diameter of Ds (mm), then the bristles 32 are implanted in a density $\rho$ ($1/mm^2$) that is greater than or equal to $30/\pi Ds$. Also, each bristle 32 has a diameter Df selected to be greater than or equal to 0.05 (mm). The individual bristle 32 presses the surface of the drum 10 with a mean pressure of $10\times10^{-5}$ (N) or above.

Figure 5:
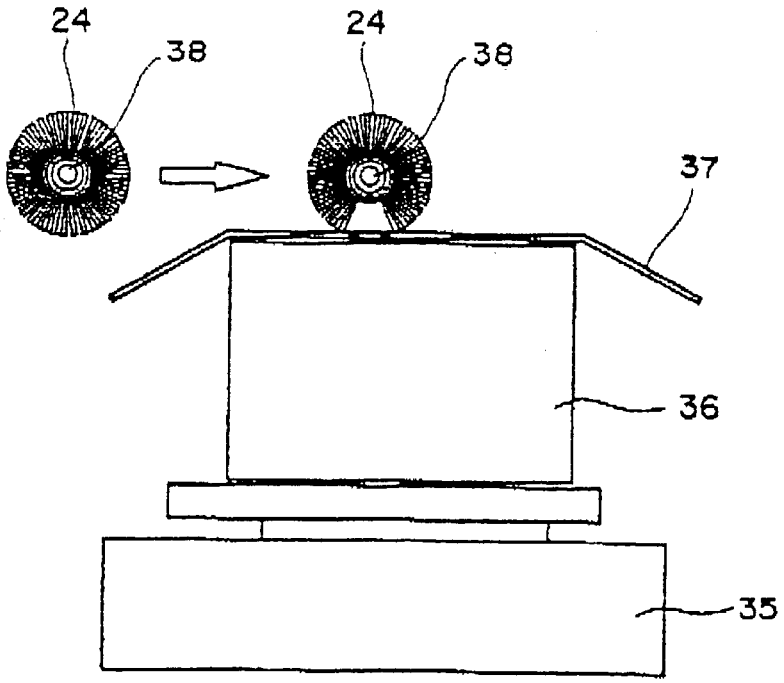
FIG. 5 is a view showing a specific arrangement for measuring a mean pressure with which the individual bristle of the brush roller presses the photoconductive element.

FIG. 5 shows a specific arrangement for measuring the mean pressure of the individual bristle 32 acting on the surface of the drum 10. As shown, the arrangement includes an electronic balance 35 held in a horizontal position. A 100-mm wide block 36 is mounted on the electronic balance 35. Further, a guide 37 is mounted on the block 36. The balance 35 is initially reset to zero. On the other hand, the shaft 38 of the brush roller 24 is affixed to a height gauge, not shown, such that the shaft 38 is parallel to the top of the block 36. Subsequently, the height of the brush roller 24 is adjusted such that the brush roller 24 bites into the block 36 by a preselected amount.

The height gauge supporting the brush roller 24 is slid to move the brush roller 24 to the top of the block 36 via the guide 37. The brush roller 24 is held in pressing contact with the top of the block 36 for 1 minute. The value of the balance 35 is read in 1 minute to determine the pressure of the brush roller 24 acting over a width of 100 mm. This pressure is divided by the number of bristles 32 in order to produce a mean pressure for a single bristle 32.

The straight bristles 32 are advantageous over loop-like bristles in that they reduce the wear of the CTL layer of the drum 10 and thereby extends the life of the drum 10. Further, the straight bristles 32 can be implanted in the drum 10 more densely than loop-like bristles in order to make stripe-like brush marks on the drum 10 inconspicuous, thereby insuring desirable image quality.

Why the bristle density $\rho$ should be greater than or equal to 30 $\pi Ds$ will be described hereinafter. Assume that $\alpha$ bristles are implanted in the cloth 31 for a unit length in the axial direction. Then, the number of bristles (linear density) $\alpha$ is expressed as:

$$\alpha=\rho\pi Ds \tag{1}$$

It was experimentally found that a linear density $\alpha$ less than 30 rendered brush marks conspicuous. By contrast, a linear density $\alpha$ of 30 or above, particularly 80 or above, successfully reduced the distance between nearby brush marks to a level that could not be observed by eye. The linear density $\alpha$ should therefore satisfy a relation:

$$\alpha \geqq 30 \quad (2)$$

or more preferably $$\alpha \geqq 80 \quad (3)$$

The equation (1) and relation (2) derive:

$$\rho \pi Ds \geqq 30$$

This relation may be modified as:

$$\rho \geqq 30/\pi Ds$$

Likewise the equation (1) and relation (3) derive:

$$\rho \geqq 80/\pi Ds$$

Figure 6:
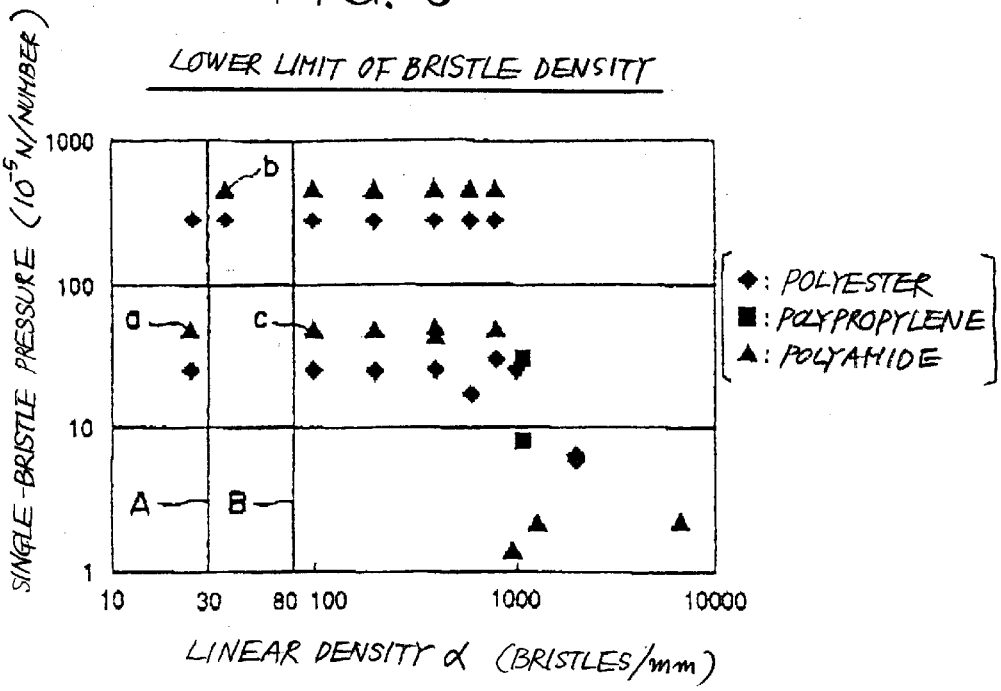
FIG. 6 is a plot showing the lower limit of a bristle density determined with polyester bristles, polypropylene bristles and polyamide bristles.

FIG. 6 plots the lower limits of densities determined with polyester bristles, polypropylene bristles and polyamide bristles. In FIG. 6, the ordinate and abscissa indicate single-bristle pressure and linear density $\alpha$, respectively. In FIG. 6, bristles a at the left-hand side of a line A and having linear densities $\alpha$ of less than 30 (bristles/mm) scratch the surface of the drum 10 in the form of stripes when used over a long period of time. Such stripes make the charge potential or the potential after exposure irregular and thereby cause white stripes or black stripes to appear in an image.

Experiments showed that bristles b whose linear density $\alpha$ was greater than 30 (bristles/mm), but smaller than 80 (bristles/mm), sometimes produced stripes when undesirable conditions occurred at the same time. However, bristles c at the left-hand side of a line B and having linear densities $\alpha$ of 80 (bristles/mm) or above did not produce any stripe in an image in most of possible conditions.

Figure 7:
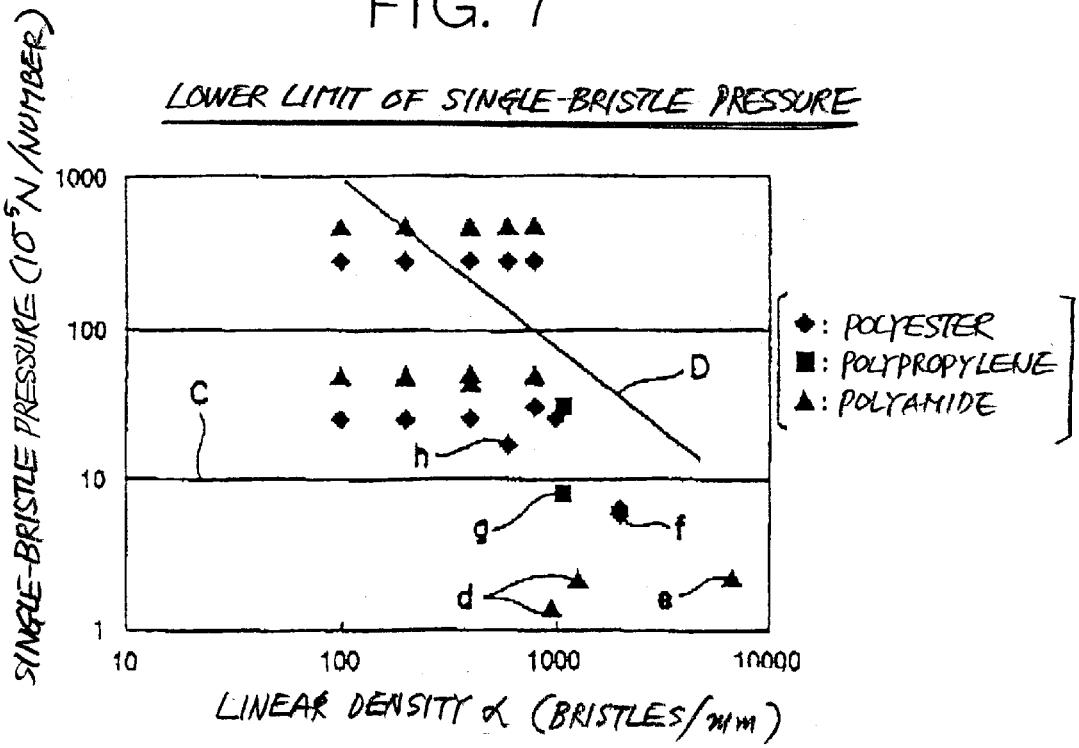
FIG. 7 is a plot showing the lower limit of the pressure of the individual bristle also determined with polyester bristles, polypropylene bristles and polyamide bristles.

FIG. 7 also plots the lower limits of densities determined with polyester bristles, polypropylene bristles and polyamide bristles. In FIG. 7, the ordinate and abscissa indicate single-bristle pressure and linear density $\alpha$, respectively. In FIG. 7, bristles d, for example, whose linear densities $\alpha$ are around 1,000 (bristles/mm) and whose single-bristle pressure is between $1\times10^{-5}$ to $6\times10^{-5}$ (N/number) are conventional. The bristles d could not exhibit a sufficient cleaning ability. Even bristles e with a higher linear density could not achieve a sufficient cleaning ability.

More than 10,000 prints were produced over a long period of time with a lubricant being applied to the drum 10. When further prints were produced in a humid environment, many images were blurred or otherwise defective. This is presumably because NOx and other active gases accumulated on the surface of the drum 10 and absorbed moisture due to the humid environment to thereby lower the surface resistance of the drum 10. The lowered surface resistance causes the charge of a latent image to scatter.

Even bristles f and g shown in FIG. 7 and having comparatively high single-bristle pressures close to $10\times10^{-5}$ (N/number) sometimes failed to achieve a sufficient cleaning ability. Specifically, assume that the charger 11 and image transfer unit 13 adjoin or contact the drum 10, and each is applied with an AC voltage. Then, the amount of contaminants to deposit on the drum 10 increases. In this condition, when the surface of the drum 10 had a relatively small coefficient of friction, a sufficient cleaning ability could not be achieved; in a humid environment, images were blurred. In the above range, it may be possible to obviate blurred or otherwise defective images by adjusting the contact condition, but a margin available is limited.

In FIG. 7, bristles h have a single-bristle pressure of $10\times10^{-5}$ (N/number) or above, i.e., above a line C were increased in rigidity. The bristles h were found to sufficiently remove the contaminants from the surface of the drum 10 even in the above-described conditions relating to the charger 11, image transfer unit 13, and drum 10. The resulting images were free from defects including blur.

A load to act on the drum 10 during rotation increases with an increase in the linear density $\alpha$ and an increase in single-bristle pressure, making straight brushes unusable in practice. A line D shown in FIG. 7 indicates a limit in this respect.

Figure 8:
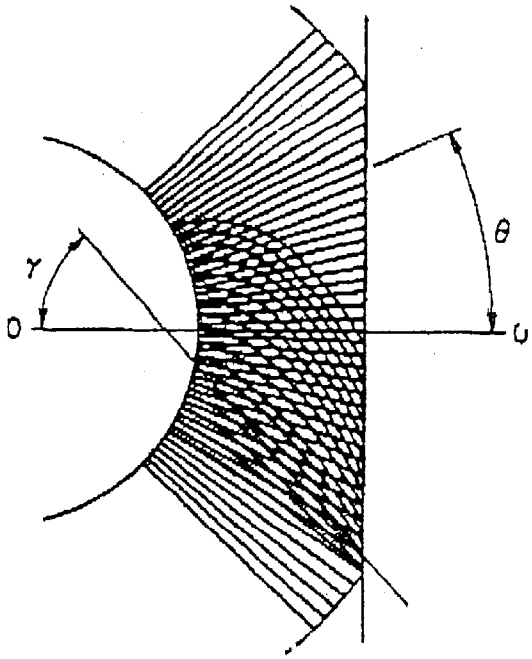
FIG. 8 is a view showing thin sheets of chrome stainless steel, playing the role of the bristles, contacting a planar surface playing the role of the photoconductive element.
Figure 9:
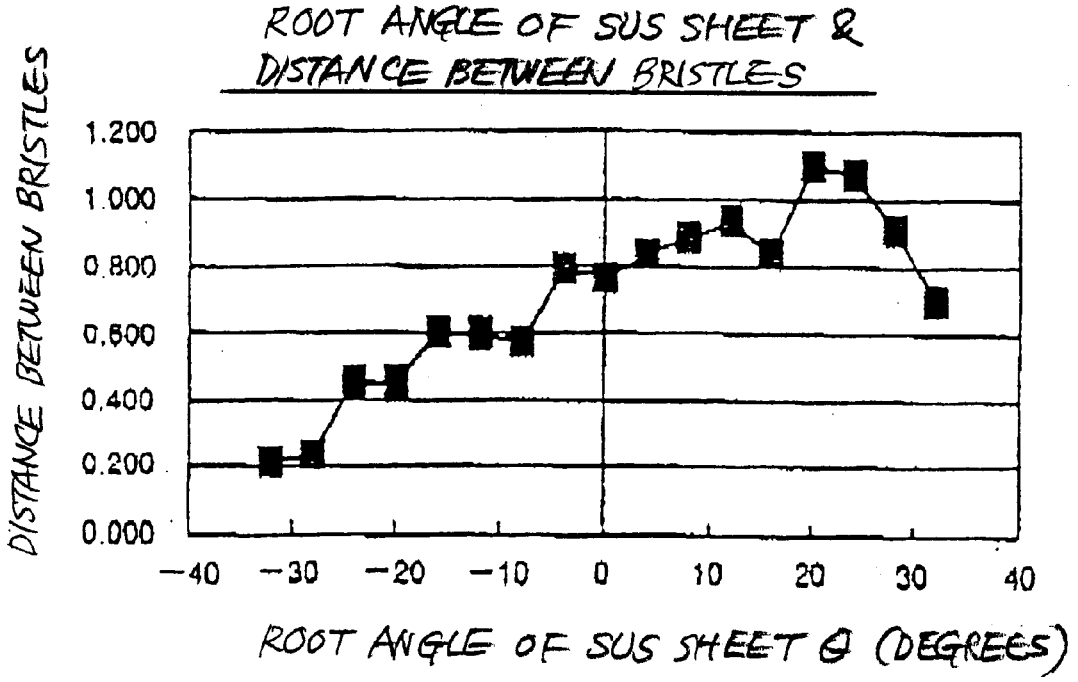
FIG. 9 is a graph showing a relation between the angle of the root of the individual chrome stainless steel sheet and the distance between nearby sheets.

FIG. 8 shows, in a ten-magnification scale, thin sheets of chrome stainless steel contacting a planar surface. The chrome stainless steel is implemented by SUS prescribed by JIS (Japanese Industrial Standards). The thin sheets and planar surface are supposed to be the bristles and drum, respectively. The bristles had a diameter of 8 mm and a length of 5 mm and implanted in a brush support having a diameter of 18 mm. The bristles were caused to bite into the drum by 1.5 mm. The position where the tip of the individual bristle contacts the planar surface was read in order to determine a distance between the tips of nearby bristles. The distance was multiplied by the tangential cos $\gamma$ of the angle $\gamma$ of the tip of the individual bristle to thereby determine a distance between nearby bristles. FIG. 9 shows such determined distances. In FIG. 9, the ordinate and abscissa indicate the distance and the angle $\theta$ of the root of the individual bristle, respectively. As for the angle $\theta$, the angle in the direction normal to the drum (line O—O) is assumed to be zero degree.

Figure 10:
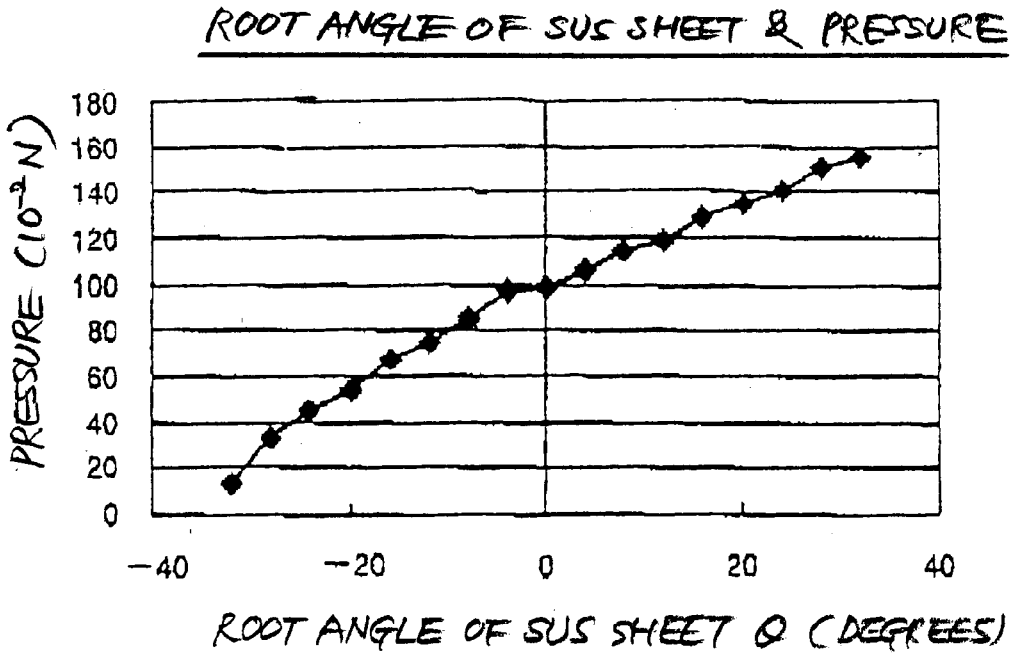
FIG. 10 is a graph showing a relation between the angle of the root of the individual chrome stainless steel sheet and the pressure.

FIG. 10 shows a relation between the angle $\theta$ of the root of the individual chrome stainless steel sheet and the pressure to act on the drum.

FIGS. 8 through 10 indicate the following:

(1) The straight bristles each contact the drum independently of the others;

(2) The distance between the bristles is smallest at a position where the bristles start contacting the drum and bend little;

(3) The distance between the bristles at the above position is about 22% of the distance measured on the cloth;

(4) A mean distance between the bristles between the above position and the initial 12 degrees is 30% of the distance measured on the cloth; and (5) A mean distance between the bristles between the above position and the initial zero degree is 50% of the distance measured on the cloth.

It follows that when a space occupancy is 30%, nearby bristles locally press each other via toner. This, however, does not cause the torque to noticeably vary because the bristles press each other around the position where they start contacting the drum and therefore bend little.

When the space occupancy exceeds 50 %, more than one half of the brushes contacting the drum press each other via toner. As a result, the bristles do not rub the drum 10 independently of each other, but even the bristles not contacting the drum 10 contribute to the pressure. Moreover, the degree of contribution of such unexpected bristles depends on the degree of yield of the bristles and the amount of toner deposited on the bristles. The above space occupancy therefore causes the pressure of the brush acting on the drum 10 and the drive torque of the drum 10 to vary.

Figure 11:
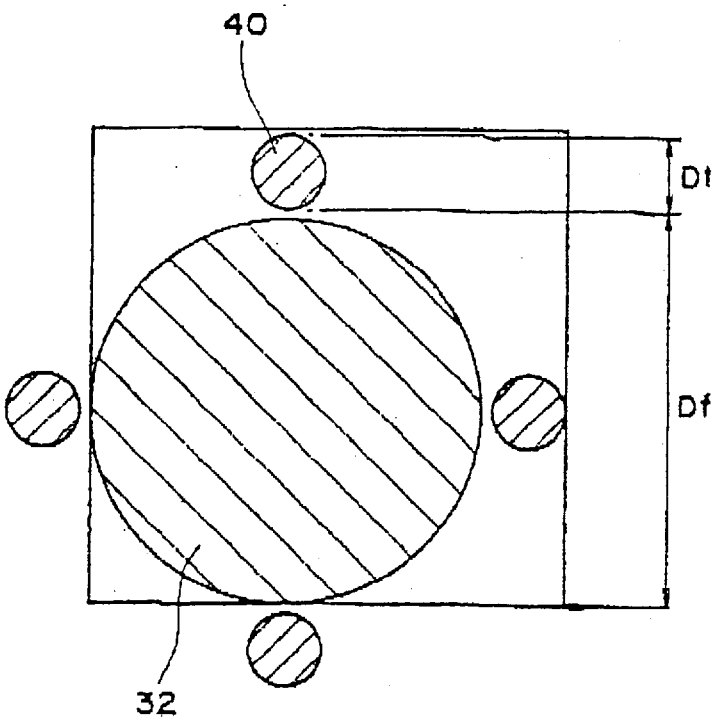
FIG. 11 is a view showing toner particles deposited on the bristles in a single layer.

As shown in FIG. 11, assume that the individual bristle 32 of the brush roller 24 has a diameter Df, and that toner particles 40 have a diameter Dt each. Then, when the toner particles 40 deposit on the bristle 32 in a single layer, the space occupancy is $(Dt+Df)^2$. By multiplying this space occupancy by the bristle density ρ, an occupancy β with respect to the cloth 31 is expressed as:

$$\beta=\rho(Dt+Df)^2 \quad (4)$$

Figure 12:
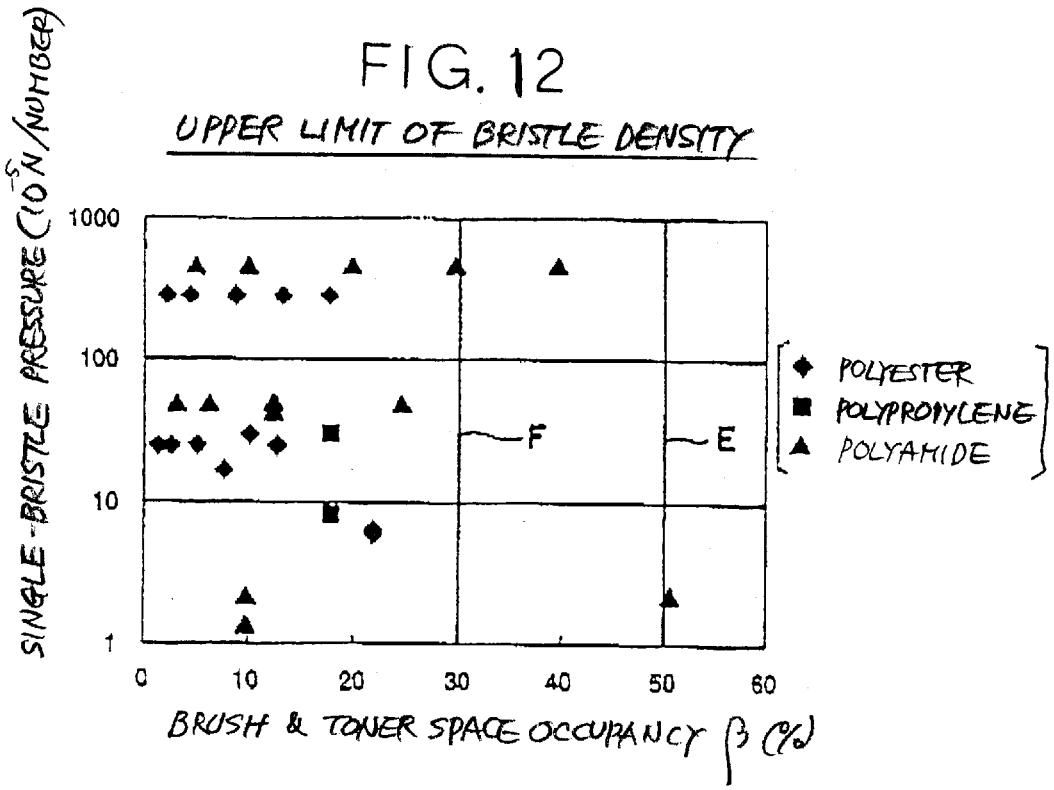
FIG. 12 is a plot showing the upper limit of a bristle density determined with polyester bristles, polypropylene bristles and polyamide bristles.

FIG. 12 shows a relation between the single-bristle pressure (ordinate) and the brush and toner space occupancy β determined with polyester bristles, polypropylene bristles and polyamide bristles. When the space occupancy β was 0.5 (%) or below (left-hand side of a line E), preferably 0.3 (%) or below (left-hand side of a line F), the toner particles 40 deposited on the bristles 32 did not noticeably increase the load on the drum 10 or did not vary it. The brush roller 24 could therefore smoothly rotate. The space occupancy β should therefore satisfy the following relation:

$$\beta \leqq 0.5 \quad (5)$$

or more preferably $$\beta \leqq 0.3 \quad (6)$$

The equation (4) and relation (5) derive:

$$\rho(Dt+Df)^2 \leqq 0.5$$

This relation may be modified as:

$$\rho \leqq 0.5/(Dt+Df)^2$$

Likewise, the equation (4) and relation (6) indicate that the bristle density ρ should preferably satisfy a relation:

$$\rho \leqq 0.3/(Dt+Df)^2$$

In the above-described type of image forming apparatus, the surface of the drum 10 should preferably have a coefficient of friction of 0.3 or below in order to reduce wear and extend the life. In the illustrative embodiment, the brush roller 24 in rotation shaves off the lubricant 25 and applies it to the drum 10, maintaining the above coefficient of friction of 0.3 or below. In addition, such a coefficient of friction promotes the easy migration of toner from the drum 10 and thereby obviates defective images.

In the illustrative embodiment, the cleaning unit has been shown and described as using the cleaning blade 24 together with the brush roller 24. However, the present invention is, of course, applicable to a cleaning unit including only a brush roller or a brush roller and a cleaning member other than a cleaning blade.

Figure 13:
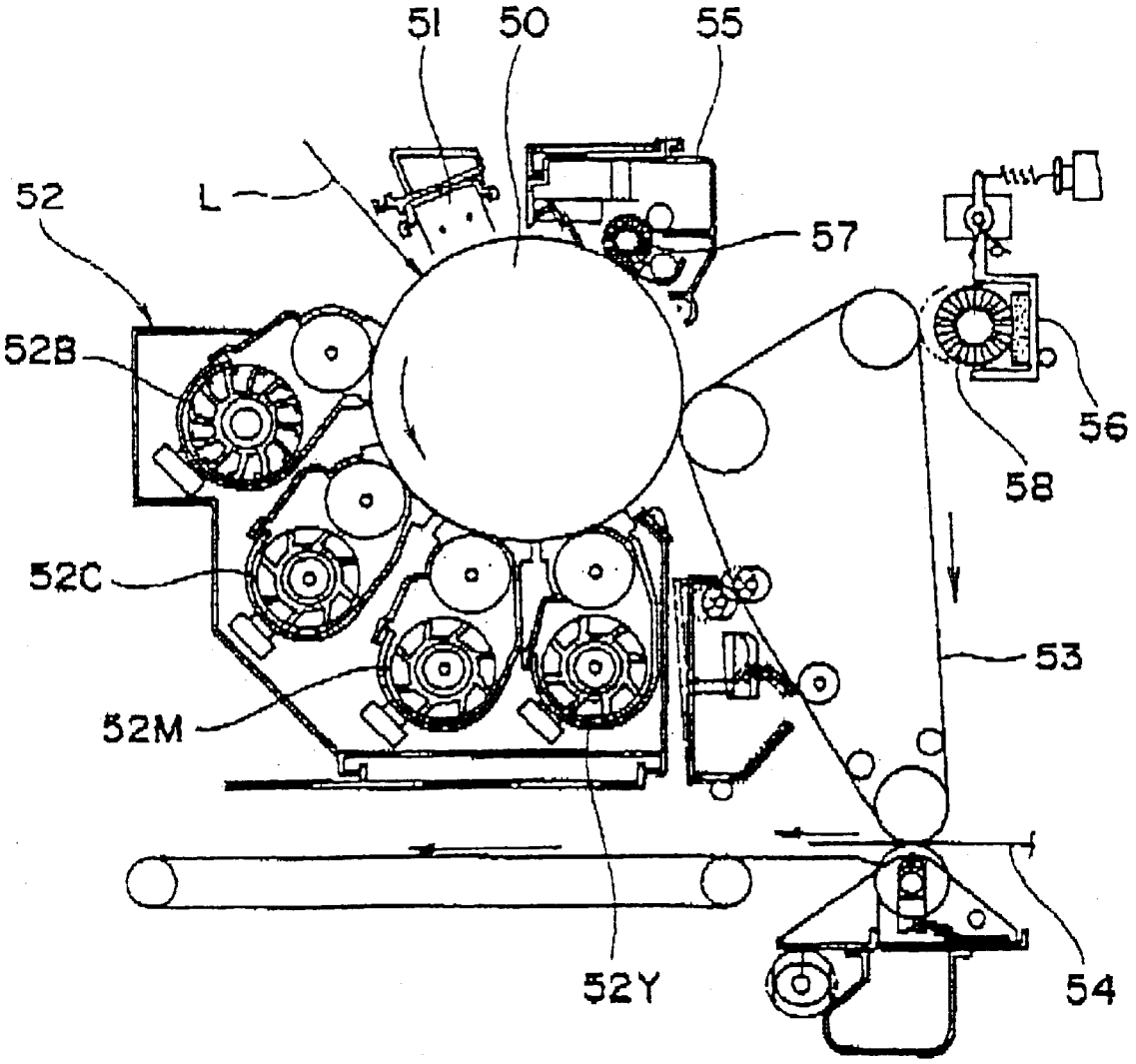
FIG. 13 is a fragmentary view of an electrophotographic color image forming apparatus to which the present invention is also applicable.

The illustrative embodiment has concentrated on a monochromatic image forming apparatus including the photoconductive drum 10. FIG. 13 shows a color image forming apparatus to which the present invention is also applicable. As shown, the color image forming apparatus includes a photoconductive drum 50, a charger 51, a developing unit 52, and an intermediate image transfer body 53. The developing unit 52 includes developing devices 52B (black), 52C (cyan), 52M (magenta) and 52Y (yellow).

In operation, while the drum 50 is in rotation, the charger 51 uniformly charges the surface of the drum 50. An optical writing unit, not shown, scans the charged surface of the drum 50 with a light beam L to thereby form a latent image on the drum 50. Subsequently, one of the developing devices 52B through 52Y develops the latent image with toner of particular color and thereby produces a corresponding toner image. The toner image is transferred from the drum 50 to the intermediate image transfer body 53.

Likewise, the other developing devices each form a particular toner image on the drum 50. Such toner images are sequentially transferred to the intermediate image transfer body 53 one above the other, completing a composite color image on the body 53. The color image is collectively transferred from the intermediate image transfer body 53 to a paper sheet 54. Cleaning units 55 and 56 respectively clean the drum 50 and intermediate image transfer body 53 after the image transfer. The cleaning units 55 and 56 include brush rollers 57 and 58, respectively.

In summary, it will be seen that the present invention provides an electrostatic image forming apparatus having various unprecedented advantages, as enumerated below.

(1) Straight bristles are implanted in a brush roller. The straight bristles reduce the wear of an image carrier and thereby extend the life of the image carrier, compared to loop-like bristles. In addition, the straight bristles can be implanted more densely than loop-like bristles in order to make brush marks on the image carrier inconspicuous, preventing image quality from being lowered.

(2) The bristles are implanted with a density ρ of 30/πDs or above in order to render the brush marks inconspicuous. Further, the individual bristle presses the surface of the image carrier with a mean pressure of $10\times10^{-5}$ (N) or above. The bristles can therefore be increased in rigidity in order to remove reactive gases, talc, clay, paper fibers and other contaminants from the image carrier. The bristles therefore achieve an enhanced cleaning ability.

(3) When the bristle density ρ is 80/πDs or above, the distance between nearby brush marks is not recognizable by eye, making the brush marks inconspicuous. This further enhances image quality.

(4) The individual bristle has a diameter of 0.5 mm or above. This readily increases a mean pressure with which the individual bristle presses the surface of the image carrier to $10\times10^{-5}$ (N) or above, thereby enhancing the cleaning ability.

(5) Because the bristle density is lower than a preselected value, the brush roller does not excessively increase a load to act on the image carrier or cause it to vary. In addition, the brush roller itself can smoothly rotate.

(6) When bristle density is reduced below the upper limit, the above advantage (5) is further enhanced.

(7) The surface of the image carrier is provided with a coefficient of friction of 0.3 or below in order to reduce wear and extend the life. Further, such a surface coefficient promotes the easy migration of toner from the image carrier, obviating defective images.

(8) The brush roller applies a lubricant to the image carrier, so that the above coefficient of friction can be easily implemented.

(9) The image carrier may be implemented by either one of a photoconductive element and an intermediate image transfer body, as desired.

(10) A cleaning unit achieves a higher cleaning ability for removing the contaminants without reducing the life of the image carrier. This successfully insures desirable image quality.

(11) The cleaning unit includes a cleaning blade in addition to the brush roller for further enhancing the cleaning ability.

Various modifications will become possible for those skilled in the art after receiving the teachings of the present disclosure without departing from the scope thereof.

What is claimed is:

1. In an electrophotographic image forming apparatus including a brush roller for cleaning a surface of an image carrier, said brush roller comprises straight bristles implanted in a density ρ ($1/mm^2$) satisfying a relation:

$$\rho \geqq 30/\pi Ds$$

where Ds denotes a diameter (mm) of a brush support included in said brush roller, and said bristles each exert a mean pressure of $10\times10^{-5}$ (N) on a surface of said image carrier.

2. The apparatus as claimed in claim 1, wherein the density ρ satisfies a relation:

$$\rho \geqq 80/\pi Ds.$$

3. The apparatus as claimed in claim 2, wherein said bristles each have a diameter Df (mm) satisfying a relation:

$$Df \geqq 0.05.$$

4. The apparatus as claimed in claim 3, wherein the density ρ satisfies a relation:

$$\rho \leqq 0.5/(Dt+Df)^2$$

where Dt denotes a mean particles size of toner.

5. The apparatus as claimed in claim 4, wherein the density ρ satisfies a relation:

$$\rho \leqq 0.3/(Dt+Df)^2.$$

6. The apparatus as claimed in claim 5, wherein a surface of said image carrier has a coefficient of friction of 0.3 or below.

7. The apparatus as claimed in claim 6, wherein said brush roller applies a lubricant to the surface of said image carrier to thereby provide said surface with the coefficient of friction of 0.3 or below.

8. The apparatus as claimed in claim 7, wherein said image carrier comprises a photoconductive element, said apparatus charging a surface of said photoconductive element, forming a latent image on said surface, developing said latent image with toner, and transferring a resulting toner image.

9. The apparatus as claimed in claim 8, wherein said image carrier comprises an intermediate image transfer body, said apparatus sequentially transferring monocolor toner images from said photoconductive element to said intermediate image transfer body one above the other and transferring a resulting color image to a recording medium.

10. The apparatus as claimed in claim 1, wherein said bristles each have a diameter Df (mm) satisfying a relation:

$$Df \geqq 0.05.$$

11. The apparatus as claimed in claim 10, wherein the density ρ satisfies a relation:

$$\rho \leqq 0.5/(Dt+Df)^2$$

where Dt denotes a mean particles size of toner.

12. The apparatus as claimed in claim 11, wherein the density ρ satisfies a relation:

$$\rho \leqq 0.3/(Dt+Df)^2.$$

13. The apparatus as claimed in claim 12, wherein a surface of said image carrier has a coefficient of friction of 0.3 or below.

14. The apparatus as claimed in claim 13, wherein said brush roller applies a lubricant to the surface of said image carrier to thereby provide said surface with the coefficient of friction of 0.3 or below.

15. The apparatus as claimed in claim 14, wherein said image carrier comprises a photoconductive element, said apparatus charging a surface of said photoconductive element, forming a latent image on said surface, developing said latent image with toner, and transferring a resulting toner image.

16. The apparatus as claimed in claim 15, wherein said image carrier comprises an intermediate image transfer body, said apparatus sequentially transferring monocolor toner images from said photoconductive element to said intermediate image transfer body one above the other and transferring a resulting color image to a recording medium.

17. The apparatus as claimed in claim 1, wherein the density ρ satisfies a relation:

$$\rho \leqq 0.5/(Dt+Df)^2$$

where Dt denotes a mean particle size of toner and Df (mm) is a diameter of each said bristles.

18. The apparatus as claimed in claim 17, wherein the density ρ satisfies a relation:

$$\rho \leqq 0.3/(Dt+Df)^2.$$

19. The apparatus as claimed in claim 18, wherein a surface of said image carrier has a coefficient of friction of 0.3 or below.

20. The apparatus as claimed in claim 19, wherein said brush roller applies a lubricant to the surface of said image carrier to thereby provide said surface with the coefficient of friction of 0.3 or below.

21. The apparatus as claimed in claim 20, wherein said image carrier comprises a photoconductive element, said apparatus charging a surface of said photoconductive element, forming a latent image on said surface, developing said latent image with toner, and transferring a resulting toner image.

22. The apparatus as claimed in claim 21, wherein said image carrier comprises an intermediate image transfer body, said apparatus sequentially transferring monocolor toner images from said photoconductive element to said intermediate image transfer body one above the other and transferring a resulting color image to a recording medium.

23. The apparatus as claimed in claim 1, wherein a surface of said image carrier has a coefficient of friction of 0.3 or below.

24. The apparatus as claimed in claim 23, wherein said brush roller applies a lubricant to the surface of said image carrier to thereby provide said surface with the coefficient of friction of 0.3 or below.

25. The apparatus as claimed in claim 24, wherein said image carrier comprises a photoconductive element, said apparatus charging a surface of said photoconductive element, forming a latent image on said surface, developing said latent image with toner, and transferring a resulting toner image.

26. The apparatus as claimed in claim 25, wherein said image carrier comprises an intermediate image transfer body, said apparatus sequentially transferring monocolor toner images from said photoconductive element to said intermediate image transfer body one above the other and transferring a resulting color image to a recording medium.

27. The apparatus as claimed in claim 1, wherein said image carrier comprises a photoconductive element, said apparatus charging a surface of said photoconductive element, forming a latent image on said surface, developing said latent image with toner, and transferring a resulting toner image.

28. The apparatus as claimed in claim 27, wherein said image carrier comprises an intermediate image transfer body, said apparatus sequentially transferring monocolor toner images from said photoconductive element to said intermediate image transfer body one above the other and transferring a resulting color image to a recording medium.

29. The apparatus as claimed in claim 1, wherein said image carrier comprises an intermediate image transfer body, said apparatus sequentially transferring monocolor toner images from said photoconductive element to said intermediate image transfer body one above the other and transferring a resulting color image to a recording medium.

30. In a cleaning unit for an electrophotographic image forming apparatus that includes a brush roller for cleaning a surface of an image carrier, said brush roller comprises straight bristles implanted in a density ρ ($1/mm^2$) satisfying a relation:

$$\rho \geqq 30/\pi Ds$$

where Ds denotes a diameter (mm) of a brush support included in said brush roller, and said bristles each exert a mean pressure of $10\times10^{-5}$ (N) on a surface of said image carrier.

31. The cleaning unit as claimed in claim 30, wherein a cleaning blade is used in combination with said brush roller as a cleaning member.

32. In a brush roller included in a cleaning unit for an electrophotographic image forming apparatus for cleaning a surface of an image carrier, said brush roller comprises straight bristles implanted in a density ρ ($1/mm^2$) satisfying a relation:

$$\rho \geqq 30/\pi Ds$$

where Ds denotes a diameter (mm) of a brush support included in said brush roller, and said bristles each exert a mean pressure of $10\times10^{-5}$ (N) on a surface of said image carrier.

* * * * *